US006328146B1

(12) United States Patent
Siwak

(10) Patent No.: US 6,328,146 B1
(45) Date of Patent: Dec. 11, 2001

(54) BAGGAGE WITH RETRACTABLE BEVERAGE CONTAINER POCKET

(75) Inventor: Todd Siwak, St. Louis, MO (US)

(73) Assignee: TRG Accessories, L.L.C., St. Louis, MO (US)

( * ) Notice: Subject to any disclaimer, the term of this patent is extended or adjusted under 35 U.S.C. 154(b) by 0 days.

(21) Appl. No.: 09/521,702

(22) Filed: Mar. 9, 2000

(51) Int. Cl.[7] ..... A45C 3/00; A45C 5/06; A45C 15/00

(52) U.S. Cl. ..... 190/109; 190/103; 190/111; 150/106; 150/116; 224/148.1; 383/117

(58) Field of Search ..... 150/106, 117; 190/103, 112, 111, 109; 224/148.5, 148.1, 148.4; 383/117

(56) References Cited

U.S. PATENT DOCUMENTS

| | | | | |
|---|---|---|---|---|
| 2,533,850 | * | 12/1950 | Syracuse | 150/117 |
| 2,717,015 | * | 9/1955 | Berry | 150/117 |
| 4,153,146 | * | 5/1979 | Patton et al. | 190/103 |
| 4,236,615 | * | 12/1980 | Ginat | 190/103 X |
| 4,354,542 | * | 10/1982 | Gerch | 150/106 X |
| 4,805,748 | * | 2/1989 | Gerch | 190/103 |
| 4,825,985 | * | 5/1989 | Kim | 190/112 X |
| 5,324,115 | * | 6/1994 | Weinreb | 190/103 X |
| 5,868,227 | * | 2/1999 | Garcia | 150/106 X |
| 5,890,809 | * | 4/1999 | Nelson | 224/148.5 X |
| 6,123,239 | * | 9/2000 | Lovitt | 190/103 X |

FOREIGN PATENT DOCUMENTS

| | | | | |
|---|---|---|---|---|
| 1479879 | * | 5/1967 | (FR) | 150/117 |

* cited by examiner

*Primary Examiner*—Sue A. Weaver
(74) *Attorney, Agent, or Firm*—Howell & Haferkamp LC

(57) ABSTRACT

A piece of baggage is provided with a retractable pocket that is configured to support a beverage container on the exterior of the piece of baggage. The pocket is constructed of a mesh material and has an elastic strap along an upper edge that allows the pocket to expand to support various size containers, such as bottled water. When not in use, the pocket can be held collapsed against or inside the piece of baggage by a closure mechanism such as a zipper. This conceals the pocket to improve the aesthetic appearance of the piece of baggage and reduces the risk of snagging the mesh pocket as the piece of baggage is transported.

23 Claims, 3 Drawing Sheets

BAGGAGE WITH RETRACTABLE BEVERAGE CONTAINER POCKET

BACKGROUND OF THE INVENTION (1) Field of the Invention

This invention pertains to the field of baggage. More particularly, this invention pertains to a pocket fashioned as part of a piece of baggage. The pocket is capable of holding a beverage container on the exterior of the piece of baggage and can be retracted so as to be substantially hidden when not being used. The retractable feature of the pocket provides the piece of baggage with a convenient place for holding a beverage container when desired without detracting from the styling or aesthetic appearance of the piece of baggage when retracted.

(2) Description of the Related Art

It has become increasingly more common for persons to carry beverages while traveling. However, holding a beverage container while also transporting a piece of baggage can become burdensome. Therefore it would be convenient for such persons to have a place for holding the beverage container so as to free one or both of their hands.

Some baggage, such as backpacks and belt pouches, address the above mentioned need by providing pockets conventionally configured to carry various beverage containers. Since it is common for persons to frequently retrieve and return beverage containers from such pockets, the pockets are typically placed on the outside of the baggage. Typically, these pockets are merely a single piece of material sewn or otherwise attached to the baggage and are often configured with an unobstructed opening to facilitate the placement and retrieval of a beverage container therefrom. Some pockets are constructed of mesh or net type material and have an elastic member adjacent their opening. The mesh material allows the pockets to more easily expand to hold various size beverage containers, while the elastic member resiliently returns the pocket to a given opening size and reduces the risk of spillage by elastically retaining a beverage container upright in the pocket. Additionally, the use of mesh material on beverage pockets has the advantage of being breathable, which facilitates evaporation of condensation formed on the exterior of chilled beverage containers. Pockets formed of a material which doesn't breathe as well as mesh can retain moisture and promote mildew and mold.

While the above mentioned pockets are convenient places for travels to hold their beverages, such pockets also have several disadvantages. Because the beverage container pockets are often positioned where they can be easily accessed as described above, the pockets are also exposed where they can easily snag or become hooked on furniture, clothing, or other fixtures. This is especially true since many such pockets hang open for ready access and are often made of mesh material. Another disadvantage of prior art beverage pockets is that many people feel that having such a pocket on a piece of baggage gives the piece of baggage a rustic or outdoorsy appearance. Such an appearance is often undesirable in professional settings. These disadvantages limit the usefulness of beverage pockets as more professional baggage is thought to require a more formal styling.

Despite a lack of specially designed pockets for beverage containers on a given piece of baggage, most traditional pieces of baggage have some form of pocket or compartment where at least a closed beverage container can be stored. However, the use of traditional pockets or compartments to hold beverage containers compromises the benefits associated with easily accessible specialized pockets as described above. Traditional pockets are often less accessible and clumsy for use as beverage holders. Additionally, condensation and spillage can cause damage to the contents of the compartment used to hold the container or even to the piece of baggage itself. This risk of damage is amplified by the fact that a traditional pocket usually doesn't include an elastic strap or other elastic retainer to help support a beverage container in an upright position.

SUMMARY OF THE INVENTION

The invention herein disclosed overcomes the disadvantages of prior art pieces of baggage by providing a collapsible pocket on the exterior of a piece of baggage that can be retracted and hidden from view when not being used. When in use, the pocket provides an easily accessible location that is specifically configured for holding a beverage container. However, unlike prior art beverage pockets, the retractable pocket of this invention can also be stored out of the way, thereby lessening the chances of the pocket becoming snagged. Furthermore, when the pocket is retracted, the pocket is concealed behind what may be a zippered closure which is streamlined and stylistic enough for professional settings.

In general, the beverage container pocket of the present invention comprises a collapsible mesh pocket and a closure mechanism, preferably a zippered closure. When expanded, the mesh pocket is flexible enough to at least partially extend outward from the exterior surface of the piece of baggage to readily receive a beverage container. When desired, the mesh pocket can be manually collapsed and the closure mechanism can be closed to hide the pocket and conform the surface of the pocket to the exterior surface of the piece of baggage.

In a first embodiment of the invention, a retractable pocket is attached to an existing piece of baggage without modification of the piece of baggage. When retracted, the pocket is held collapsed against the exterior of the piece of baggage by a shroud that also partially conceals the pocket. In an alternative embodiment, the piece of baggage itself is specifically configured for use with the invention by having an internal cavity in which the pocket can be stored when not being used. Regardless of the particular embodiment, the use of the invention is not limited to any particular type of baggage and various types of baggage such as briefcases, luggage, backpacks, and purses can benefit therefrom.

While the principal advantages and features of the present invention have been described above, a more complete and thorough understanding of the invention may be attained by referring to the drawings and detailed description of the embodiments which follow.

DETAILED DESCRIPTION OF THE INVENTION

Figure 1:
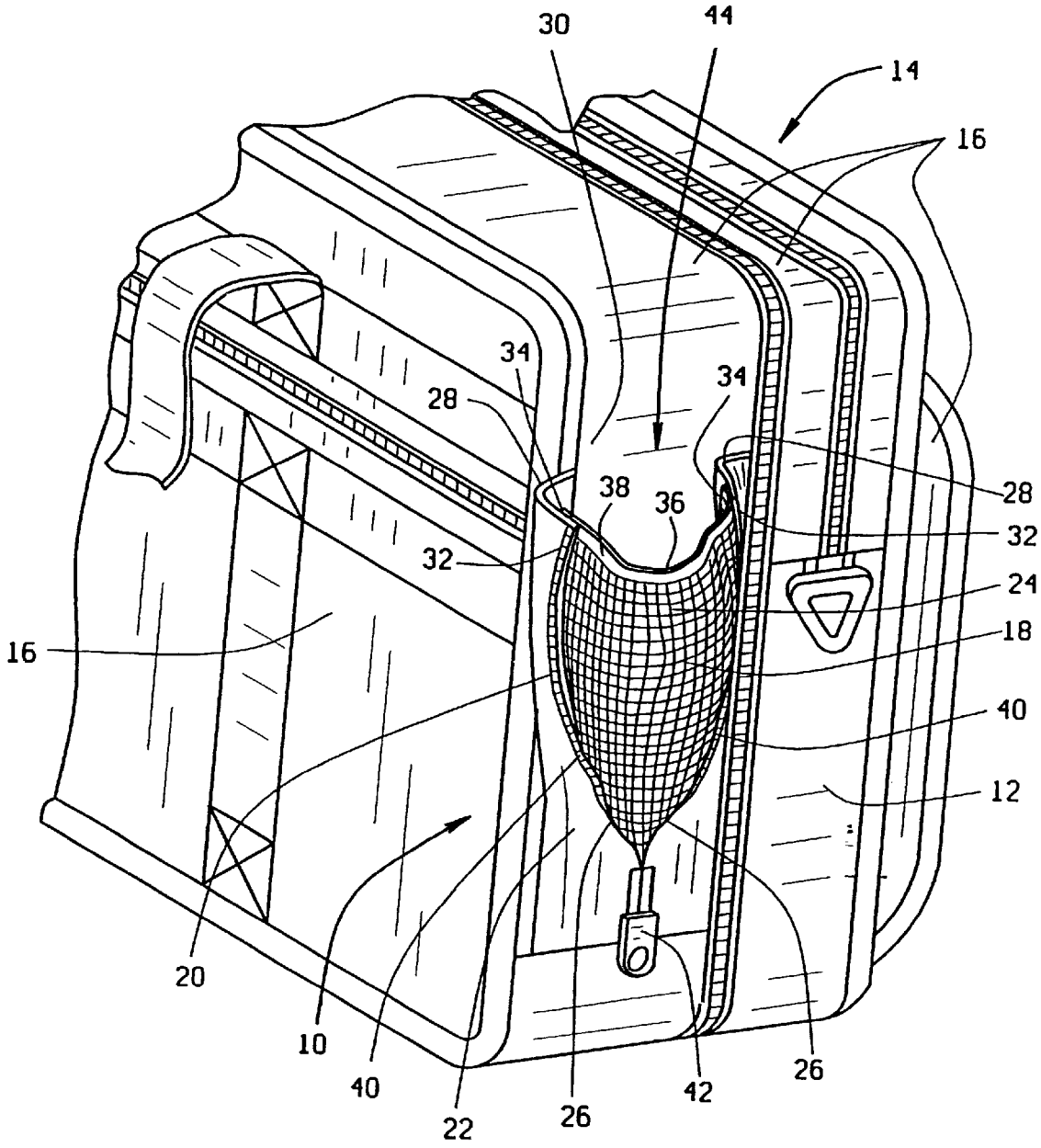
FIG. 1 is a partial isometric view of a first embodiment of the invention showing the pocket in the operable position.
Figure 2:
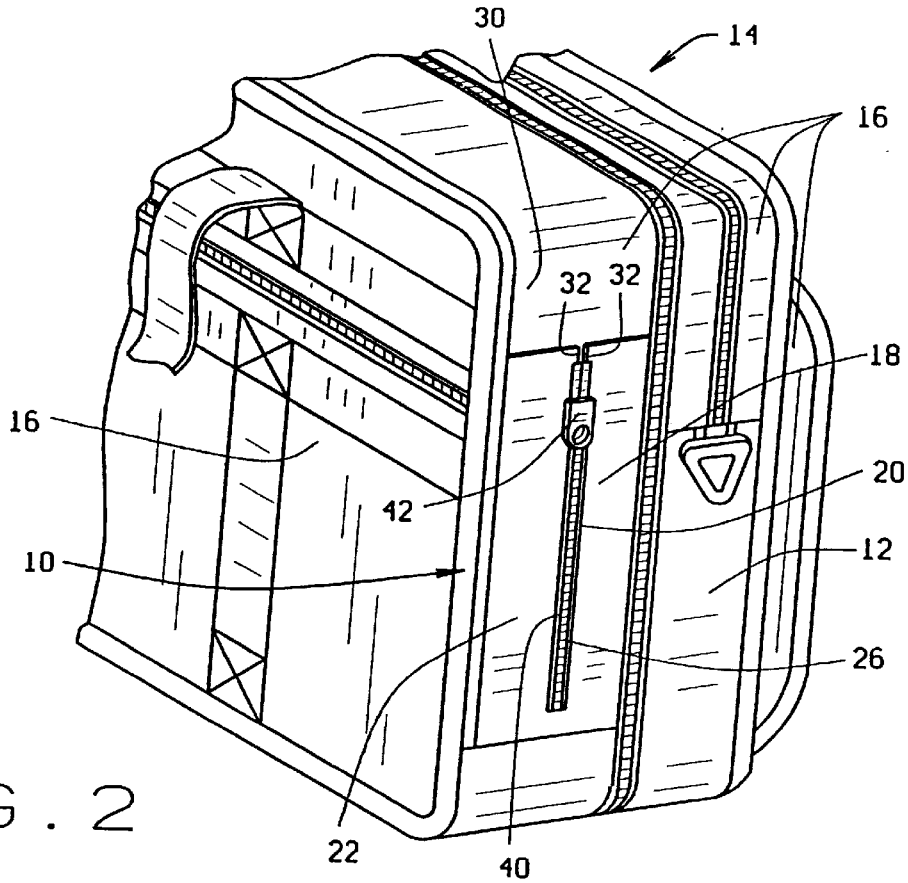
FIG. 2 is a partial isometric view of the first embodiment showing the pocket in the collapsed position and hidden from view by the closure.

A first embodiment of a retractable pocket in accordance with this invention is shown in an expanded/operable position in FIG. 1 and in a retracted/hidden position in FIG. 2. The first embodiment 10 of the retractable pocket is preferably positioned on an end 12 of a piece of baggage 14 where it will not interfere with other compartments 16 of the piece of baggage 14. The retractable pocket 10 comprises a pocket 18 and a closure mechanism 20 that can be used to hold the pocket 18 in a retracted position.

The pocket 18 of the first embodiment 10 is itself comprised of a shroud portion 22 and a mesh portion 24. The shroud portion 22 of the pocket 18 is preferably made from the same material that is used to fashion the exterior of the piece of baggage 14. The shroud 22 is preferably rectangular in shape with a slit 26 extending downward from the approximate center of its upper edge 28. Except for the upper edge 28 of the shroud 22, the perimeter of the shroud is sewn or otherwise fastened to the exterior surface 30 of the piece of baggage 14 such that the shroud will lie substantially flat against the exterior of the piece of baggage 14 when the opposite edges 32 of the slit 26 are brought together.

The mesh portion 24 of this embodiment 10 is preferably a trapezoidal piece of mesh material having two equal length side edges 34 and opposite upper 36 and lower(not shown) edges. The side edges 34 of the mesh portion 24 are preferably slightly longer than the length of the slit 26 in the shroud 22 such that, with the upper edge 36 of the mesh portion aligned with the upper edge 28 of the shroud, the side edges of the mesh portion can be sewn or otherwise attached to the opposite edges 32 of the slit on the backside of the shroud and the lower edge of the mesh can be attached beneath the slit on the backside of the shroud. The mesh portion 24 may also preferably have an elastic member 38 sewn or otherwise attached to its upper edge 36.

The closure mechanism 20 of this embodiment 10 is preferably a zipper 40 that is attached along the opposite edges 32 of the slit 26 where it can be operated to hold the opposite edges 32 together when the slider 42 of the zipper 40 is raised. With the slider 42 of the zipper 40 lowered, the opposite edges 32 of the slit 26 naturally separate to expose the mesh portion 24 for use. In this position as shown in FIG. 1, the upper edge 28 of the shroud 22 on each side of the slit 26 and the upper edge 36 of the mesh 24 help form an opening 44 into the pocket 18. The elasticity of the elastic member 38 and the flexibility of the mesh 24 allow the opening 44 of the pocket to be resiliently expanded from its relaxed configuration to accommodate various sizes and shapes of beverage containers. Furthermore, this resiliency helps center such beverage containers and hold them upright against the exterior surface 30 of the piece of baggage 14, thereby reducing the risk of spillage. The use of mesh material also facilitates evaporation if any condensation is formed or if spillage occurs, and helps prevent any unintended accumulation of moisture within the pocket 18. Additionally, the portion of the exterior surface 30 of the piece of baggage 14 underlying the pocket 18 can be made water repellent to prevent any moisture from damaging the exterior surface or unintentionally seeping through the exterior surface to damage the contents of the piece of baggage.

When not using the pocket 18 to hold a beverage container, the mesh portion 24 of the pocket can be collapsed behind the shroud 22 against the exterior surface 30 of the piece of baggage 14 and the slider 42 of the zipper 40 can then be raised. In this raised or closed position of the closure mechanism as shown in FIG. 2, the shroud lies substantially flat over the mesh and adjacent the exterior surface 30 of the piece of baggage 14, thereby reducing the risk of snagging the pocket while also concealing the mesh portion 24 of the pocket and thereby streamlining the appearance of the baggage 14.

Figure 4:
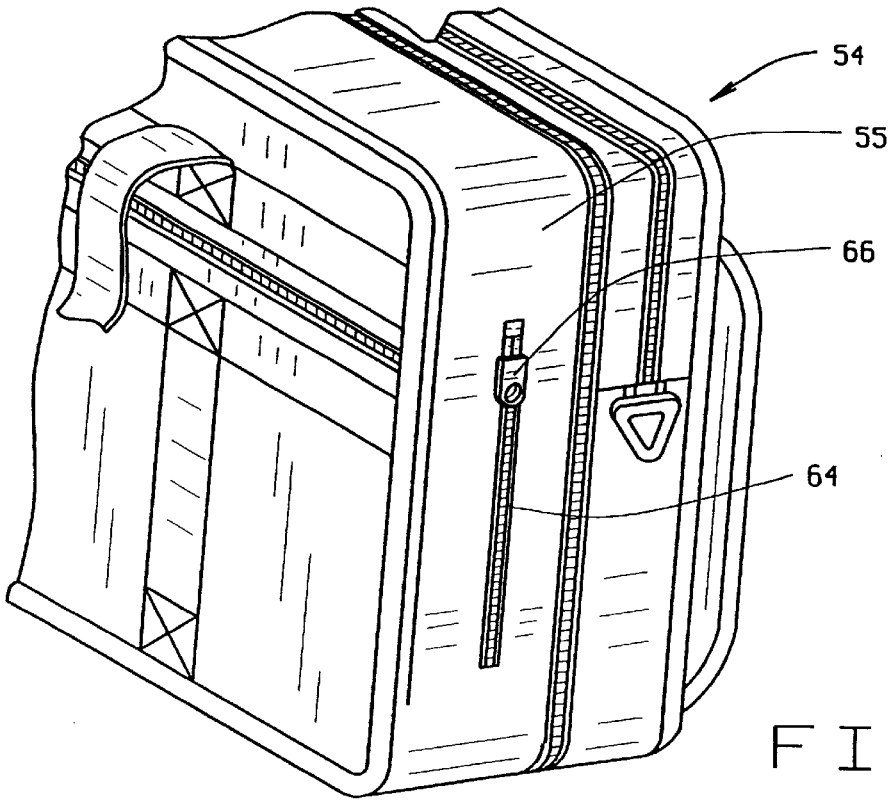
FIG. 4 is a partial isometric view of the embodiment shown in FIG. 3 with the pocket retracted within an envelope of the piece of baggage and hidden from view by the closure mechanism.
Figure 3:
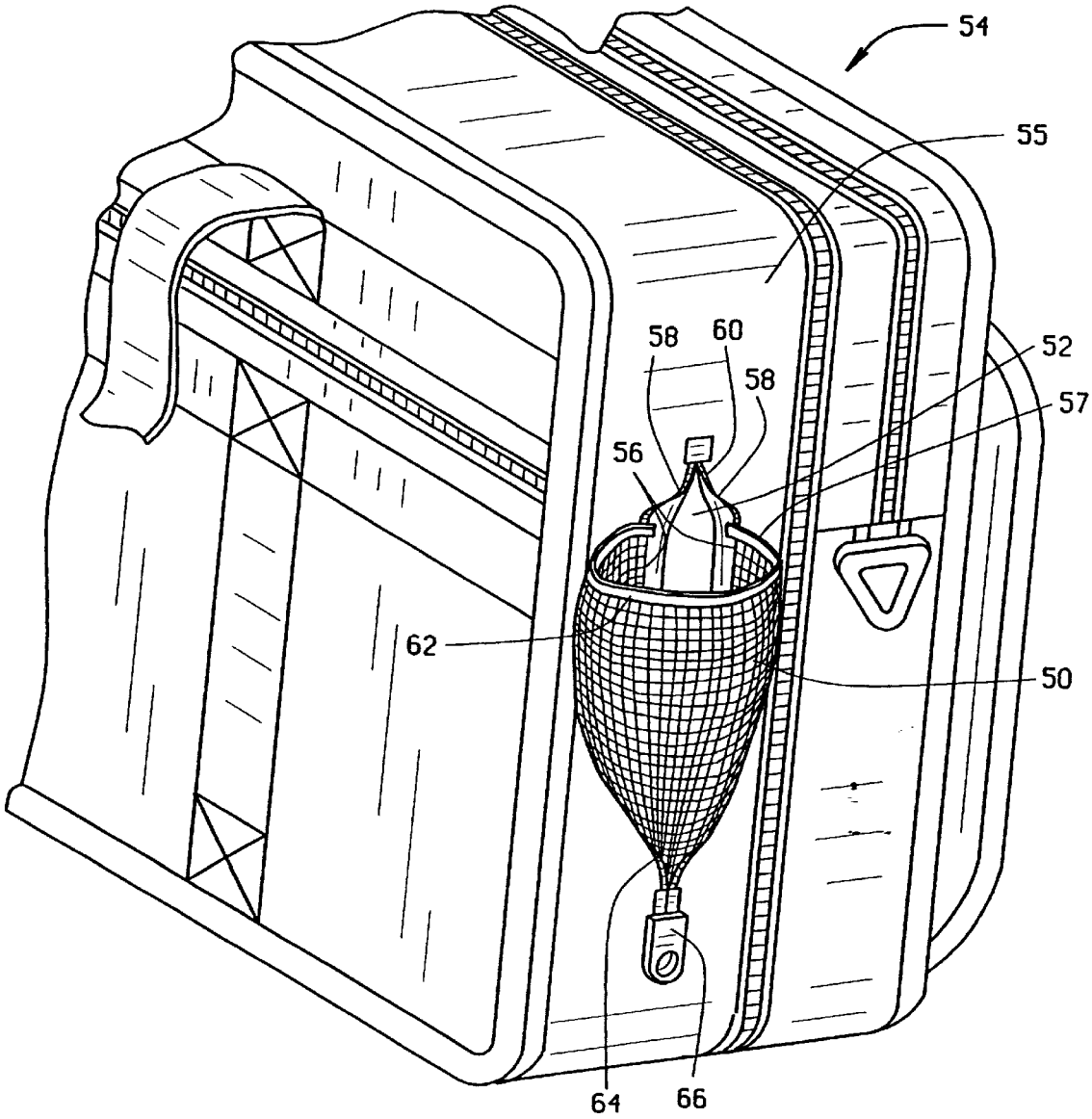
FIG. 3 is a partial isometric view of an alternative embodiment of the invention showing the pocket in the operable position.

An alternative embodiment of the invention is shown in FIGS. 3 and 4. In this alternative embodiment, the pocket 50 is attached to an interior cavity 52 of the piece of baggage 54, rather than to the exterior surface 55. The pocket 50 is preferably formed of a single trapezoidal piece of material having equal length side edges 56 and a larger top edge 57 than bottom edge (not shown). The side edges 56 of the pocket 50 are preferably sewn to the back side of the opposite edges 58 of a vertical slit 60 that extends through the exterior surface 55 of the piece of baggage 54. An elastic strap 62 is preferably attached to the top edge 57 of the pocket 50 and the bottom edge of the pocket 50 is preferably sewn to the back side of the exterior surface 55 of the baggage 54 below the vertical slit 60. In this embodiment, the pocket 50 is preferably made of mesh as described above. The mesh material allows the pocket 50 to be collapsed into a very small volume which, in this embodiment, is merely the cavity space between the exterior surface 55 of the piece of baggage 54 and backing material inside the piece of baggage behind the slit 60.

Like the first embodiment, the closure mechanism of the embodiment shown in FIGS. 3 and 4 is a zipper 64 that is positioned along the opposite edges 58 of the vertical slit 60 where it can operate to hold the opposite edges 58 of the vertical slit 60 together when closed. With the slider 66 of the zipper 64 lowered, the vertical slit 60 is open and the pocket 50 expands outward or can be pulled outward through the slit 60 as shown in FIG. 3. When in this position, the pocket functions as described above to support a beverage container therein. When not in use, the pocket can be collapsed into the interior cavity 52 and the slider 66 of the zipper 64 can be raised to close the vertical slit 60 and hide the pocket 50 in the interior cavity 52 as shown in FIG. 4. In this position the pocket is concealed and is not exposed to be snagged on other items or fixtures.

It is convenient to perhaps think of these two embodiments as being surface mounted as in the first embodiment and flush mounted as in the second embodiment. This perhaps best describes the relationship between the pocket and the exterior surface of the piece of baggage in that, in the first embodiment the pocket extends beyond the silhouette of the exterior surface of the piece of baggage while in the second embodiment the pocket is hidden beneath the exterior surface of the piece of baggage.

It should be understood that, although the invention has been described above in reference to specific embodiments, the invention is not limited to these embodiments and numerous alternative embodiments or changes to these embodiments could be made without departing from the scope of the invention. As an example, the embodiments herein disclosed could be modified by utilizing various suitable materials in place of the materials described above and the shapes of the various components could be altered. Additionally, the zipper could easily be replaced in the above described embodiments by other closure mechanisms suchs as VELCRO™, buttons, snaps, latches, and magnetic clasps.

In other embodiments, the closure mechanism need not necessarily be a device for attaching things together. For example, an embodiment similar to the embodiment shown in FIGS. 3 and 4 could utilize a resilient slit that can resiliently expand to open and close without the need of a closure mechanism to secure the opposite edges of the vertical slit together when closed. Likewise, the shroud may be made of a material which has sufficient resiliency that it closes itself to hide the pocket.

In yet another embodiment, a retractable pocket similar to that of the first embodiment could have the mesh portion attached to the exterior surface of the piece of baggage behind a shroud, rather than being attached to the shroud itself. In such an embodiment, the shroud, although no longer forming a portion of the pocket, would still operate to retract and conceal the pocket. Such an embodiment could also be modified such that the shroud is made without a slit and has only one side edge attached to the piece of baggage such that it can be selectively hinged about the attached edge to reveal a pocket therebehind.

Thus it should be clear that modifications and variations of the invention could be made without departing from the scope of the invention which should be considered as being limited only by the scope of the claims and their equivalents.

What is claimed:

1. A beverage container holder for a baggage, comprising:

a collapsible pocket attached adjacent an exterior surface of the baggage, the pocket being re-configurable between an expanded and a collapsed position, the pocket being adapted to receive and support a beverage container when the pocket is in the expanded position;

a closure mechanism operatively connected to the baggage, the closure mechanism being selectively adjustable between an open and a closed position, the closure mechanism being configured to allow the pocket to be re-configured between the expanded and collapsed positions when the closure mechanism is in the open position and the closure mechanism being configured to restrain the pocket in the collapsed position when the closure mechanism is in the closed position; and a shroud attached to the exterior surface of the baggage, the shroud being configured to conceal a portion of the pocket when the closure mechanism is in the closed position.

2. The beverage container holder of claim 1, wherein:

the shroud also forms a portion of the pocket.

3. The beverage container holder of claim 1, wherein:

a portion of the pocket comprises a mesh material and an elastic member attached to the mesh material so as to allow the pocket to resiliently expand.

4. The beverage container holder of claim 3, wherein:

the shroud is configured to conceal the mesh material when the closure mechanism is in the closed position.

5. The beverage container holder of claim 4, wherein:

the shroud comprises a generally rectangular sheet having opposite side edges and opposite top and bottom edges, the shroud portion having a slit therethrough extending perpendicularly from the center of the top edge towards the bottom edge, the mesh portion having opposite edges attached to the shroud portion adjacent opposite edges of the slit, the opposite edges of the slit being configured to separate and the mesh portion extend therebetween when the pocket is in the expanded position, and the closure being configured to hold the opposite edges of the slit together when the closure is in the closed position to thereby hold the pocket in the collapsed position.

6. The beverage container holder of claim 1, wherein:

the closure mechanism is a zipper.

7. The beverage container holder of claim 1, wherein:

the shroud has a slit with opposite edges and a portion of the pocket is formed by a piece of material having opposite side edges, one of the opposite side edges of the piece of material is attached adjacent one of the slit edges and the other of the opposite side edges of the piece of material is attached to the other of the slit edges.

8. The beverage container holder of claim 1, wherein:

the pocket has an opening edge defining an opening into an interior of the pocket and the pocket has two, opposite side edges at opposite ends of the opening edge; and the shroud has a slit that defines two portions of the shroud on opposite sides of the slit, the two side edges of the pocket are secured to the two portions of the shroud with the pocket extending across the slit, the pocket is extendable through the slit where the pocket is suspended from the baggage by the two portions of the shroud to support a beverage container inserted through the pocket opening into the pocket interior and the pocket is collapsible through the slit where the pocket is held within the two portions of the shroud when not in use.

9. The beverage container holder of claim 8, wherein:

the closure mechanism is attached to the two portions of the shroud and is operable to open and close the slit.

10. The beverage container holder of claim 9, wherein:

the closure mechanism is a zipper.

11. The beverage container holder of claim 8, wherein:

the two portions of the shroud have edges on opposite sides of the slit and the two side edges of the pocket are secured to the edges of the two portions of the shroud.

12. The beverage container holder of claim 11, wherein:

the opposite ends of the pocket opening edge are secured to the edges of the two portions of the shroud.

13. The beverage container holder of claim 8, wherein:

the opposite ends of the pocket opening edge are secured to the two portions of the shroud on opposite sides of the slit.

14. A piece of baggage comprising:

a retractable flexible pocket fashioned as part of the baggage, and a receptacle for the pocket, the receptacle having a closure mechanism for concealing the pocket within the receptacle, the receptacle comprising a shroud mounted to an exterior surface of the piece of baggage, the shroud having a slit extending along a length thereof, the closure mechanism comprising a device for closing the slit.

15. The piece of baggage of claim 14, wherein:

the shroud also forms a portion of the pocket.

16. The piece of baggage of claim 14, wherein:

the closure mechanism is a zipper.

17. The piece of baggage of claim 14, wherein:

the shroud slit has opposite edges and a portion of the pocket is formed by a piece of material having opposite side edges, one of the opposite side edges of the piece of material is attached adjacent one of the slit edges and the other of the opposite side edges of the piece of material is attached to the other of the slit edges.

18. The piece of baggage of claim 14, wherein:

the pocket has an opening edge defining an opening into an interior of the pocket and the pocket has two, opposite side edges at opposite ends of the opening edge; and the shroud slit defines two portions of the shroud on opposite sides of the slit, the two side edges of the pocket are secured to the two portions of the shroud with the pocket extending across the slit, the pocket is extended through the slit where the pocket is suspended from the piece of baggage by the two portions of the shroud to support a beverage container inserted through the pocket opening into the pocket interior and the pocket is collapsible through the slit where the pocket is held within the two portions of the shroud when not in use.

19. The piece of baggage of claim 18, wherein:

the closure mechanism is attached to the two portions of the shroud and is operable to open and close the slit.

20. The piece of baggage of claim 19, wherein:

the closure mechanism is a zipper.

21. The piece of baggage of claim 18, wherein:

the two portions of the shroud have edges on opposite sides of the slit and the two side edges of the pocket are secured to the edges of the two portions of the shroud.

22. The piece of baggage of claim 21, wherein:

the opposite ends of the pocket opening edge are secured to the edges of the two portions of the shroud.

23. The piece of baggage of claim 18, wherein:

the opposite ends of the pocket opening edge are secured to the two portions of the shroud on opposite sides of the slit.

* * * * *